US008074590B2

(12) United States Patent
Bentley

(10) Patent No.: US 8,074,590 B2
(45) Date of Patent: Dec. 13, 2011

(54) METHOD AND SYSTEM FOR FREEHAND AND REALTIME QUILTING WITH A COMPUTER-CONTROLLED QUILTING MACHINE

(76) Inventor: Arthur Bentley, Sandy, UT (US)

( * ) Notice: Subject to any disclaimer, the term of this patent is extended or adjusted under 35 U.S.C. 154(b) by 311 days.

(21) Appl. No.: 12/331,831

(22) Filed: Dec. 10, 2008

(65) Prior Publication Data

US 2009/0151612 A1 Jun. 18, 2009

Related U.S. Application Data

(60) Provisional application No. 61/013,010, filed on Dec. 12, 2007.

(51) Int. Cl.
*D05B 19/00* (2006.01)

(52) U.S. Cl. ..... 112/470.04; 112/470.01

(58) Field of Classification Search ..... 112/102.5, 112/470.01–470.04, 470.06, 475.19; 700/136–138
See application file for complete search history.

(56) References Cited

U.S. PATENT DOCUMENTS

| | | | | |
|---|---|---|---|---|
| 4,072,114 | A * | 2/1978 | Sugiyama et al. | 112/470.07 |
| 4,998,489 | A * | 3/1991 | Hisatake et al. | 112/470.04 |
| 5,005,500 | A * | 4/1991 | Kato et al. | 112/470.04 |
| 5,095,835 | A * | 3/1992 | Jernigan et al. | 112/470.04 |
| 5,319,566 | A * | 6/1994 | Kongho et al. | 700/138 |
| 5,323,722 | A * | 6/1994 | Goto et al. | 112/102.5 |
| 6,990,914 | B2 * | 1/2006 | Canan | 112/119 |
| 7,386,361 | B2 * | 6/2008 | Nobuyuki et al. | 700/138 |
| 2007/0005175 | A1 * | 1/2007 | Konig et al. | 700/138 |
| 2007/0221108 | A1 * | 9/2007 | Koerner | 112/119 |

* cited by examiner

*Primary Examiner* — Nathan Durham
(74) *Attorney, Agent, or Firm* — Bateman IP; Brett Peterson

(57) ABSTRACT

A computer-controlled quilting machine uses a hand held stylus to create the patterns which are sewn into a quilt. The machine can quilt in real time, following the movement of the stylus as a user traces any desired object or design. The machine allows a user to easily sew a desired pattern into a quilt, and also provides greater access to quilting to those persons who are unable to operate other types of quilting machines, while retaining much of the appeal of hand quilting.

14 Claims, 4 Drawing Sheets

METHOD AND SYSTEM FOR FREEHAND AND REALTIME QUILTING WITH A COMPUTER-CONTROLLED QUILTING MACHINE

RELATED APPLICATIONS

The present application claims the benefit of U.S. Provisional Application Ser. No. 61/013,010, filed Dec. 12, 2007, which is incorporated herein by reference in its entirety.

BACKGROUND OF THE INVENTION

1. The Field of the Invention

The present invention relates to quilting. More specifically, the present invention relates to a system for quilting which allows a person to operate a computer controlled quilting machine with a freehand input device, and which allows the quilting machine to sew while following the movement of the input device in real time.

2. State of the Art

Quilting has been both a craft and a hobby for hundreds of years, if not longer. Typically, quilting involves making a quilt or another object from one or more pieces of fabric and may include a soft batting placed between layers of cloth. The pieces of cloth may even be sewn from smaller pieces of cloth in a decorative pattern. The actual quilting of the object is accomplished by sewing through the cloth layers and batting to both attach them together and to form a decorative pattern in the finished object. While it is understood that many objects can be quilted, the present application will primarily discuss the making of actual quilts for simplicity. It will be appreciated that the methods and devices discussed herein will apply to a variety of objects which are made in a like manner.

Traditionally, persons have performed all of the sewing by hand, without the use of a machine. As sewing machines became more commonplace, persons would often sew the two cloth pieces by hand if a decorative pattern is used, and would then perform the quilting by hand. As quilting became more common, quilting machines became available which could perform the quilting step much more quickly and easily than can be done by hand.

While many persons prefer to quilt by hand, many other persons lack the skill, time, or physical ability to quilt by hand. Old age, physical handicaps, or arthritis prevent many persons from quilting by hand. To further allow persons who lack sufficient desire or ability to quilt by hand to be able to quilt, computer controlled quilting machines have been developed which automatically move the sewing machine relative to the quilt and sew in a predetermined pattern to sew the pattern into the quilt.

FIG. 1 shows a typical prior art computer-controlled quilting machine. The machine, sometimes called a quilting robot, typically includes rollers 10 which hold a quilt 14 so that a portion 18 of the quilt 14 is stretched tight and positioned where a sewing machine 22 is able to sew on the portion 18 of the quilt 14. The sewing machine 22 is mounted to an X-Y carriage (not shown) which uses motors to move the sewing machine in two dimensions to sew in the area 18. FIG. 2 shows a typical known X-Y carriage 42 which may be used in the system of FIG. 1. The carriage 42 includes a base 46 for mounting a sewing machine, support rods 50 which allow the base 46 to move left and right as indicated by arrow 54, and support rods 58 and brackets 62 which allow the base 46, support rods 50, and brackets 62 to move forwards and backwards as indicated by arrow 66. Typically, the base 46 and brackets 62 include rollers or the like to facilitate motion across the rods 50, 58, and motors such as stepper motors are used to move the base 46 and brackets 62 relative to the rods 50, 58.

The quilt 14 is held in a fixed location, and the carriage 42 moves the sewing machine relative to the quilt. A computer 26 controls the sewing machine 22 and carriage 42, controlling the motion, stitching, etc. The system of FIG. 1 may include a screen 30 to allow the user to select patterns and operate the quilting machine.

A person will typically purchase software which includes sewing patterns, load the patterns onto the computer 26 via a disk drive 34 or the like, and use these patterns to finish the quilt 14. The user will typically select a pattern, select how big the pattern is to be sewn on the quilt 14, move the sewing machine 22 to a fixed starting position for the pattern, and start the machine to automatically sew the pattern into the quilt 14.

While the available computer-controlled quilting machines provide significant improvements in allowing many more persons to quilt, they still have significant setbacks. For example, they typically require a person to purchase set quilting patterns in electronic format and sew these patterns into the finished object. The user can control which pattern is being used and can change the size or position of the pattern, but otherwise has very limited control over the sewing.

Some computer-controlled quilting machines allow a person to input a custom pattern, but require the person to physically move the sewing machine 22 across the area 18 of the quilt 14 to record the movements of the sewing machine 22 as a pattern into the computer. The sewing machine 22 may include handles 38 to facilitate movement of the machine. The recorded pattern can then be repeatedly sewn on the quilt 14. It is appreciated that it is difficult to physically move the sewing machine 22 across the quilt 14, as the sewing machine and X-Y carriage may weigh 50-75 pounds or more. As such, persons who have physical difficulty quilting will typically have difficulty moving the sewing machine 22 around by hand. Even if the person is able to move the sewing machine 22, the resulting pattern may be rough and uneven due to the difficulties in moving the sewing machine.

It will be appreciated that while computer-controlled quilting machines have improved the ability of many persons to quilt, they have significant limitations on what the person may quilt. Additionally, the use of a computer-controlled quilting machine eliminates the charm of a hand quilted object by providing perfectly controlled stitching and perfectly formed and generic patterns. Much of the charm of hand quilted objects is also lost due to the generic look of the patterns available for these quilting machines.

There is a need for a computer-controlled quilting machine which allows a person to easily control the sewing of the machine using freehand drawing inputs such that the machine quilts the pattern which is drawn by the person. There is a need for a quilting machine which can quilt in real time, following the freehand inputs of a user, to sew the patterns drawn by a user into a quilt or other object.

SUMMARY OF THE INVENTION

It is an object of the present invention to provide an improved computer-controlled quilting machine.

According to one aspect of the invention, a quilting machine is provided which allows a person to draw or trace a pattern with a stylus and which then sews the pattern into a quilt. The machine tracks the movement of the stylus and can automatically create a sewing path from the traced pattern.

The machine allows a person to trace virtually any object with the stylus and sew the pattern which is traced into a quilt or the like.

According to another aspect of the present invention, the quilting machine can quilt, in real time, the pattern being traced by the stylus.

These and other aspects of the present invention are realized in a method and system for freehand and real-time quilting with a computer-controlled quilting machine as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
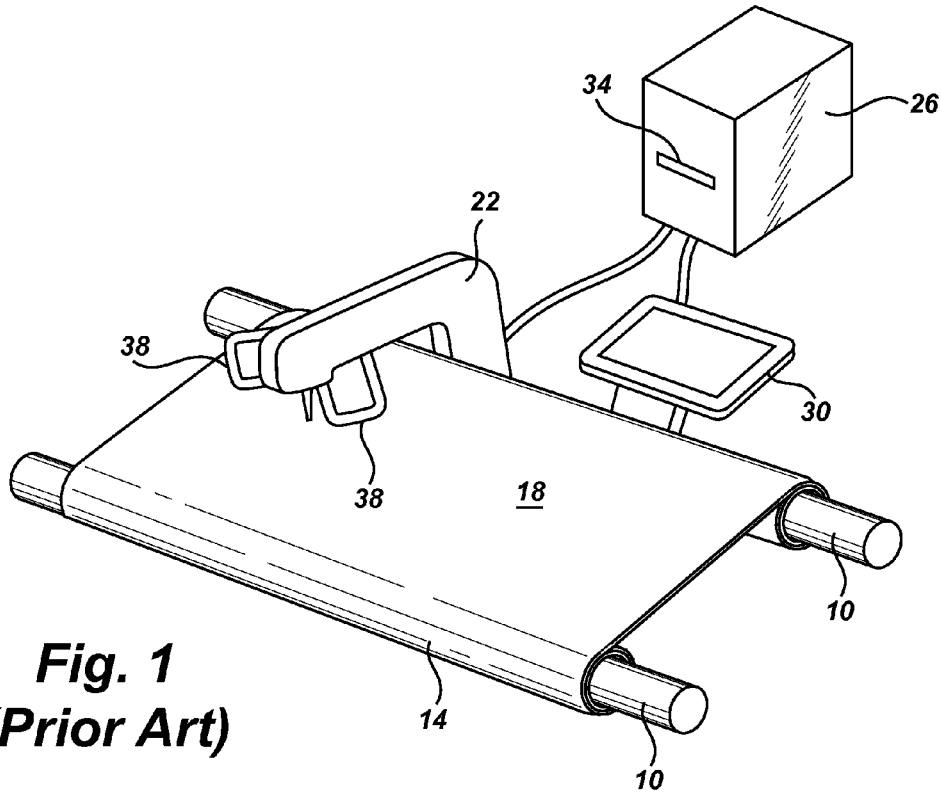
Fig. 1 (Prior Art)
FIG. 1 shows a perspective view of a computer-controlled quilting machine of the prior art.
Figure 2:
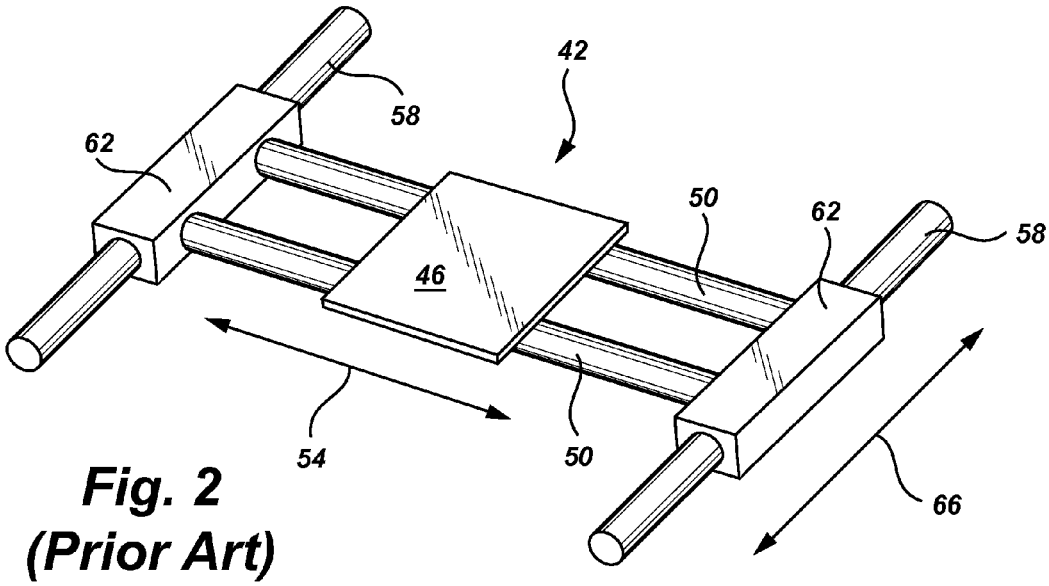
Fig. 2 (Prior Art)
FIG. 2 shows a perspective view of a sewing machine carriage of the prior art.
Figure 3:
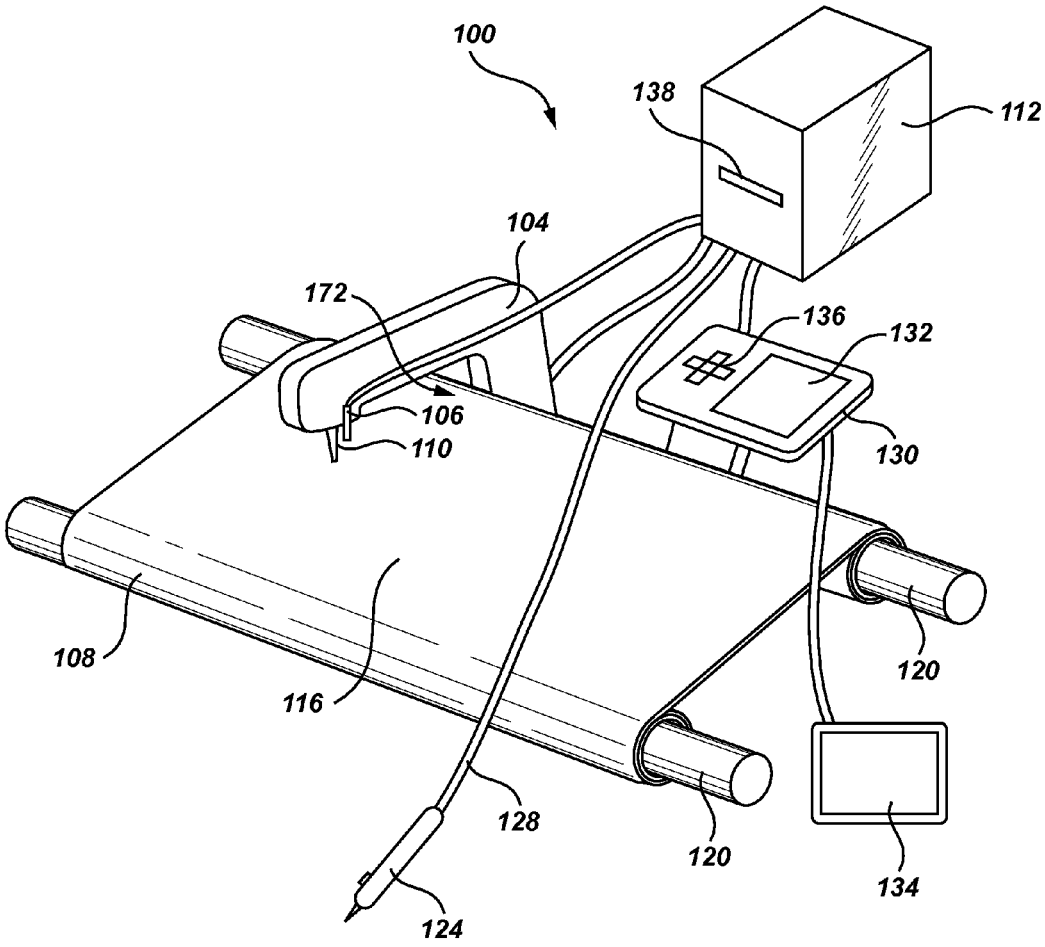
FIG. 3 shows a perspective view of a computer-controlled quilting machine of the present invention.

Turning now to FIG. 3, a perspective view of a computer-controlled quilting machine 100 of the present invention is shown. The quilting machine 100 includes a sewing machine 104 which is mounted to a carriage to move the sewing machine 104 relative to a quilt 108. The carriage may be a known style of carriage as is shown in FIG. 2. The construction and operation of such a carriage is well known in the art. A computer 112 is used to control the movement of the carriage and the operation of the sewing machine 104 such that the sewing machine sews in the available area 116 of the quilt 108. If necessary, a needle position sensor 106 may be used to track the position of the sewing needle 110. The needle position sensor 106 may be used to determine whether the needle is in the up or down position or whether a stitch has been completed. The needle position sensor 106 may be an optical sensor or encoder, an electromagnetic sensor and magnet, or another suitable sensor. It is appreciated that the computer 112 need not be a full desktop style computer (although such a computer would be capable of performing the necessary processing functions) but will typically be a smaller dedicated computer processor. It will be appreciated that the computer 112, while shown separately, may be part of the interface 130, sewing machine 104, etc. It will be appreciated that the necessary processors and components of the computer 112 will be relatively small, and they may be housed fairly easily in the interface 130 or in a small housing.

The quilt 108 is typically mounted to spools 120 by wrapping the quilt around the spools as shown to expose a portion 116 of the quilt 108 and to keep the quilt tight enough for sewing. Although not shown, the spools 120 are typically mounted to a table or to the X-Y carriage so that the quilt maintains some tension in the area 116 being sewn and so that the sewing machine 104 can move relative to the quilt and sew properly. A simple X-Y carriage as is shown in FIG. 2 may be used to allow the sewing machine to move relative to the quilt and sew patterns therein. As is understood, such a carriage uses stepper motors or the like to move the carriage.

One embodiment of the present invention uses a hand-held stylus 124 or similar hand held device to control the movement of the sewing machine 104. The computer 112 tracks the movement of the stylus 124 and moves the sewing machine 104 accordingly to stitch the quilt 108. According to a preferred embodiment, the stylus 124 contains an optical sensor which tracks movement across the surface beneath the stylus to track the movement of the stylus. Although the stylus 124 is shown with a cable 128 to connect the stylus to the computer 112, a wireless connection may also be used if desired. Additional details of the stylus 124 are described in reference to FIG. 4 below.

The quilting machine 100 may be provided with a user interface 130 including a screen 132 and a keypad 136 to allow a user to control aspects the machines operation. The user may use the keypad to move the sewing machine 104 to a location to start sewing, or to scroll through different machine functions. The screen 132 may be used to display the available options in operating the quilting machine 100, or to display the machine settings or functions selected by the user. Thus, the user may use the buttons 136 to scroll through available machine features or options as displayed on the screen 132 and select the desired options or otherwise control the operation of the sewing machine. The screen 132 may also allow the user to enter sewing patterns into the computer 112.

As such, the screen 132 may be a touch screen and a person may use a conventional stylus or even their finger to trace or draw patterns on the screen to thereby store the sewing pattern into the computer 112 and sew the pattern into the quilt. Alternatively, the quilting machine 100 may be provided with a display screen 132 and a graphics tablet 134. The display screen 132 displays items such as the operational mode of the quilting machine 100 and may be used to change the operational mode as discussed, and may also display the pattern being created/sewn by the user. The graphics tablet 134 is typically a capacitive type drawing tablet (although other drawing tablet technologies may be equally used) and is used to trace patterns and enter the same into the computer. Additionally, the graphics tablet 134 may be used to select the operational modes of the quilting machine 100, such as by using selected portions of the graphics table 134 as buttons or a virtual keyboard. This may be facilitated by printed outlines or overlays for the graphics tablet 134. It is thus observed that a few different types of interfaces 130 are suitable for operating the quilting machine 100, allowing the user to trace patterns and directly store these patterns for later use or to quilt these patterns into a quilt 108 in real time.

A drive 138, such as a USB port or a flash memory card slot, may be provided to allow users to transfer patterns between quilting machines 100 or to save a large number of patterns onto their home computer. The drive 138 allows a person to trace and create a sewing pattern and then save the pattern onto a computer. This allows the person to use the pattern for later work.

The sewing machine 104 may be integrated into the quilting machine 100 in a variety of different ways. Preferably, the sewing machine can be controlled by the computer 112 directly interfacing with the sewing machine's control unit. If this is not possible, the computer 112 can connect to the port where a conventional foot control pedal is connected and can use this port to run the sewing machine motor and operate the sewing needle. A sensor can be attached to the hand wheel or the take up lever to sense the position and/or speed of the needle (how fast the needle moves up and down, and thus how fast stitches are being made) and thereby control the rate of stitching relative to the movement speed of the X-Y carriage. If even this is not possible, the computer 112 can operate a variable clamp which compresses the foot control of the sewing machine. Such a clamp would fit around the conventional sewing machine foot pedal and use a motor, solenoid, etc. to compress the foot pedal a desired amount in order to control the speed of the sewing machine. The needle speed sensor would be used to sense the needle speed and allow the computer 112 to track the needle speed and control the needle speed relative to the X-Y carriage movement. This allows the stitch length to be regulated, producing a consistent stitch length.

Typically, persons desire that the stitches are of a uniform length, as this is typically more aesthetically pleasing. In addition to varying the needle speed according to the carriage speed as discussed above, the speed of the X-Y carriage may be adjusted according to the needle speed. In some situations it may be desirable to keep the speed of the needle constant or within a certain range. In these situations, the speed of the X-Y carriage may be adjusted so that the carriage moves the sewing machine a desired distance for every stitch. This method may require that the carriage movements are slightly delayed relative to the user input, if the user is tracing the pattern while sewing the same pattern. The size of the stitches may be adjusted by controlling the carriage speed. If large stitches are necessary, the carriage may move faster. If small stitches are necessary, the carriage may move slower to move less distance for each stitch.

Alternatively, the needle speed may be adjusted according to the carriage movements. In this manner, the carriage can be moved around as fast as desired, or at least as fast as the needle can be operated. The user will typically have selected a desired number of stitches per inch. This is reduced into a length for each stitch. The computer monitors the movement of the stylus, and thus the movement of the sewing machine. to determine if the stylus/sewing machine is actually moving or is simply oscillating about a single point due to the stylus sensors or the carriage motors moving between point locations in an attempt to hold a stationary position. If the computer determines that the stylus/sewing machine is actually moving and not oscillating at a certain point, the computer will record the net movement of the stylus/sewing machine.

The location of the previous stitch is recorded. The user selected stitch length is squared and stored as a distance value in the computer. The computer then tracks the X and Y movement of the sewing machine and adds the square of the X movement and the square of the Y movement. When the sum of the square of the X movement and the square of the Y movement equals the square of the stitch length, the needle is moved to form another stitch, and the new stitch location is recorded as the new reference point. As such, the computer uses the Pythagorean Theorem to determine when a stitch is necessary according to the distance moved from the last stitch. The computer thus is able to follow a pattern which a person traces in real time while maintaining proper stitch length. The computer 112 is also able to take any pattern which a person has loaded or saved into the computer, allow it to be scaled to any size, and sew the pattern into a quilt while maintaining a desired stitch length.

Effectively, the stitch distance is used as an imaginary circle drawn around the previous stitch location and the computer calculates when the carriage has moved the needle to the edge of the circle, requests another stitch, and forms a new imaginary circle around that new stitch location. As most sewing machines operate by continuously moving the needle, the time period between stitch requests generated by the computer can be averaged so that an average stitch speed can be calculated, and this stitch speed can be used to control the sewing machine needle speed. The sewing machine speed can be adjusted according to a predetermined number of previous stitches. This is a preferred method of regulating the stitch length when the user is tracing a pattern and sewing the pattern in real time, as the computer can follow the traced pattern with the carriage movements and adjust the sewing machine speed to control the stitch length. Alternatively, the speed of the carriage can be adjusted so that the time period between stitch requests from the computer matches the time between stitches for the desired sewing machine speed.

One problem that computer controlled quilting machines have typically experienced is producing good corners. A good corner is typically produced by placing a stitch in the corner rather than moving past a corner without placing a stitch in the corner. If the computer moves past a corner without forming a stitch the corner becomes rounded rather than having a sharp corner. The computer 112 produces good corners by determining where there is a corner in the pattern and using a needle sensor to make sure that a stitch is placed in the corner before moving past the corner. Thus, if the stitching speed is constant, the computer 112 may dwell at the corner for a short period of time until a stitch is made. If the stitching speed is variable, the computer may cause a stitch to be made once reaching the corner and then resume the normal stitch length after leaving the corner. The computer 112 is thus able to take any pattern, whether stored in memory or traced or entered in real time, and automatically sew the pattern into a quilt while using a user selected stitch length and without rounding off corners present in the pattern.

Figure 4:
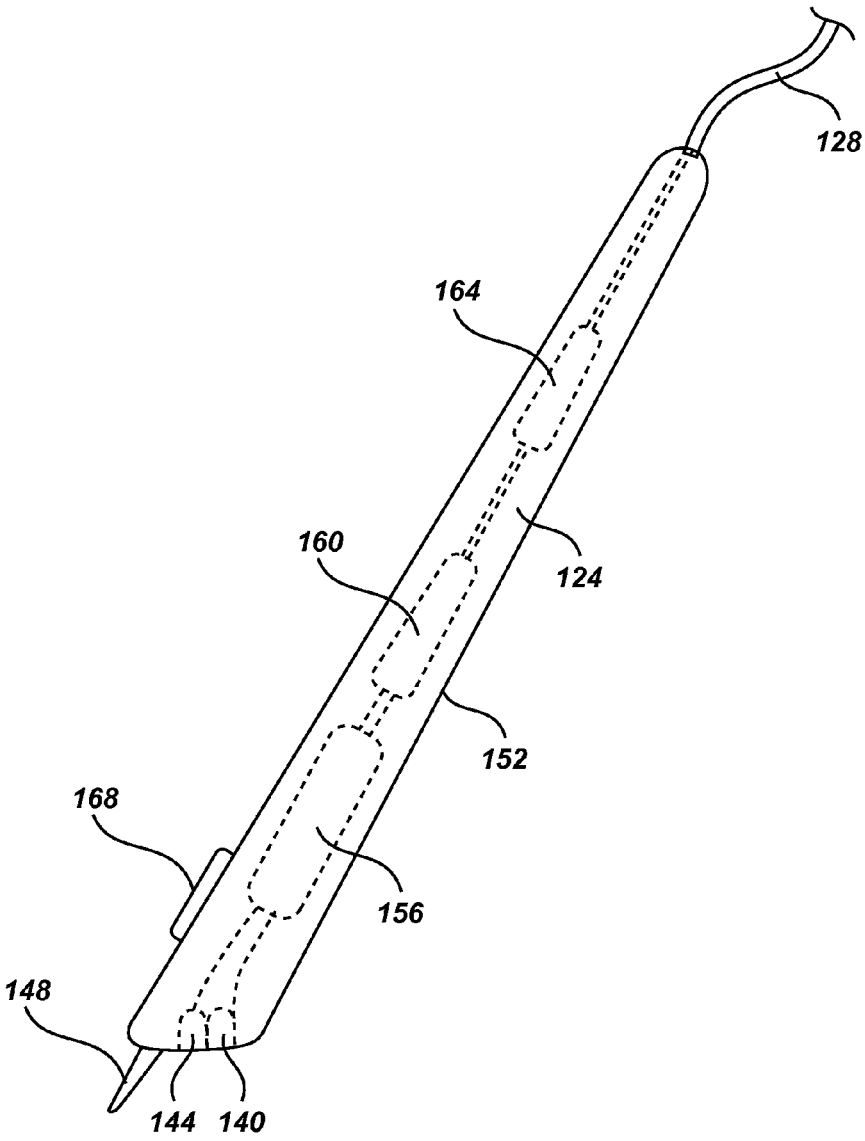
FIG. 4 shows a stylus for the quilting machine of FIG. 3.

Turning now to FIG. 4, a side view of a stylus 124 according to the present invention is shown. The stylus 124 typically includes an LED 140 and photo sensor 144 which are used to record the movement of the stylus across a surface in a manner similar to the operation of an optical mouse. The stylus 124 may also include a pointed tip 148 which helps a user maintain the proper distance away from the "drawing" surface, which may be a drawing which is being traced or the quilt 108 itself. The pointed tip 148 will also help the user to more precisely observe and control the movement and location of the stylus 124. The body 152 of the stylus 124 is elongate so as to resemble a pencil, providing a stylus which is very easy and natural for persons to use.

The stylus 124 may include processor circuitry 156 to control the operation of the LED 140 and photo sensor 144, and may also include a battery 160 and a wireless transceiver 164 to allow for wireless use rather than using a cable 128 to communicate with the computer 112. It will be appreciated that if a wireless stylus 124 is desired, the stylus will typically contain the necessary control circuitry 156, battery 160, and transceiver 164. If a wired stylus 124 is desired, the control circuitry 156 and other necessary electronics may be contained within the computer 112 or a remote module, allowing the stylus 124 to be reduced in size. Thus, a stylus 124 which is shaped like a sewing thimble may be made, allowing a person to place the stylus on a finger tip and trace the pattern to be sewn with their finger.

The stylus 124 may also include one or more buttons 168. A button could be used to start or stop sewing when tracing a pattern, or could be used with the display screen 132 to navigate through the features of the quilting machine. Thus, the button 168 could be used to toggle between a mode where the stylus 124 movements are tracked to draw the pattern which is to be sewn and a mode where the stylus movements are not included in the pattern. Thus, the stylus 124 could be used to move the sewing machine 104 into a desired position to start sewing a pattern. The button 168 could similarly be used to indicate portions within a pattern which are not sewn, but where the sewing machine 104 is moved to a different position to resume sewing.

A button 168 could also be used to navigate through menus and to adjust the mode of operation of the sewing machine. A user could depress a button 168 to open a menu on the screen 132 and to select or unselect options within the menu. When in such a menu, movement of the stylus 124 could be used to move back and forth between different menu items, such as scrolling through a list of options. The user could thus control many aspects of the operation of the quilting machine 100 with the stylus 124. With the use of a computerized sewing machine 104, the user could even adjust aspects of the sewing machine operation such as thread tension with the stylus 124.

Although a pencil shaped stylus using light sensors is shown, other stylus shapes and configurations could be made. For example, the stylus could be a light pen and screen, a touch screen and plastic stylus without electronics therein, etc. As mentioned earlier, the computer may include a touch screen which a person may use with a stylus or their finger. The touch screen may be part of the interface 130, or may be a separate screen which the user may place in a convenient location for use. While the discussion herein is primarily directed towards the stylus 124 as the preferred embodiment, a touch screen may be similarly used to draw and enter patterns for sewing into a quilt.

A fundamental aspect of the operation of the quilting machine 100 is that the movement of the stylus 124 will create the pattern which is sewed by the sewing machine 104. Thus, the user may trace or follow a desired pattern with the stylus 124 as though they were drawing with a conventional pen or pencil, and the quilting machine 100 will use the pattern in operating the sewing machine 104 to sew the pattern into the quilt 108. The stylus 124 is typically used against a surface. Thus, a user may use the stylus 124 to trace a photo or drawing, to draw freehand, or even to trace or outline a pattern on the quilt itself and have the quilting machine 100 sew the desired pattern into the quilt 108.

The quilting machine may operate in a few major modes. In each mode of operation, the user may trace or otherwise draw a pattern with the stylus and the computer 112 will record the pattern and sew the pattern into a quilt 108. Certain functions or features of the quilting machine 100 will be substantially the same in either mode of operation. For example, the user may use the keypad 136 to position the sewing machine 104 at a desired location to start sewing a pattern into a quilt 108. Alternatively, the user may use the stylus 124 to move the sewing machine 104 into a desired position.

In a first mode of operation, the quilting machine operates in real time, sewing a pattern into a quilt 108 while the user traces the pattern with the stylus 124. The user would typically move the sewing machine 104 into a desired starting position, place the sewing machine into a sewing mode, and then trace a desired pattern while the quilting machine 100 moves the sewing machine 104 and sews the pattern into a quilt 108. The sewing machine 104 would faithfully transfer the pattern traced by the user into the quilt.

The computer 112, controlling the X-Y carriage and the sewing machine 104, could adjust for variables in the tracing of the pattern itself. For example, the user may speed up and slow down while tracing a desired pattern. The computer 112 could use a slight time delay in sewing the pattern to buffer the movement speed to be a more consistent speed. Thus, the computer 112 could use a memory buffer to record the pattern traced by the user and sew the pattern into the quilt a short period of time after the patter is traced. If the user traces the pattern at a speed faster than the X-Y carriage and sewing machine can operate, the computer can operate the quilting machine at the maximum speed and catch up with the users' tracing when the user slows down at a future time. Additionally, the computer could correlate stitching speed to the speed of movement of the X-Y carriage such that a uniform stitch length is always produced regardless of variation in the speed at which the user traces the stitching pattern.

When operating in a real time quilting mode, the computer 112 can simultaneously record the pattern being traced by the user as well as sewing the pattern into a quilt 108. The pattern is stored in the computer 112 and can be repeated later to create duplicate patterns on the quilt.

In another mode of operation, the quilting machine does not sew in real time but records the patterns traced by a user for later sewing. This mode may be better suited for complicated patterns where a user may take a longer period of time to trace the pattern, or for patterns which are to be repeated in one or more quilts or in multiple locations on a quilt.

In this mode of operation, the user would use the stylus 124 to trace a desired pattern and the computer 112 would store the pattern into memory for later use. When the user is ready to sew the pattern into a quilt 108, the user would position the sewing machine 104 at a desired starting location and the quilting machine 100 would sew the pattern into the quilt 108.

The computer 112 can allow the pattern to be scaled if desired. To scale the pattern, the user would typically enter into a scaling part of the menu and choose a fraction or percentage to scale the pattern. The pattern could be made larger or smaller. As such, patterns which have been previously stored into the computer 112 can be repeated on a quilt in varying sizes. Additionally, the computer 112 can scale patterns while sewing the pattern in real time. The computer can simply apply a scaling factor to the movements of the stylus 124 as the user traces the pattern. Thus, the quilting machine will sew the pattern either smaller or larger than it is actually traced. This feature is useful where the user wishes to sew a picture or the like into a quilt, but the picture is the wrong size. The user can determine how much the picture should be scaled and can trace the picture and the quilting machine 100 can automatically sew the traced pattern in the correct size in the quilt 108.

The ability to trace a pattern with a stylus 124 provides several advantages. It allows a user to quickly and easily input any desired pattern into the quilting machine 100 and sew the same into a quilt 108. The user can take a photograph of a person, an heirloom object, or any object and trace the same with the stylus 124 to quilt the desired pattern into a quilt 108. A person can even take flowers petals or leaves and easily trace the object and quilt the traced pattern into a quilt 108. Thus, the present invention provides a user with the ability to sew virtually any pattern or object into a quilt 108 with ease, and without the need to manually generate a computer file to control the quilting machine 100.

As has been discussed above, the sewing patterns may be traced using a variety of different user interfaces 130, such as a touch screen, graphics pad, or optical pen. Each of these may have different advantages. The use of a touch screen or a graphics tablet allows the person to use their finger or a conventional stylus to trace the pattern onto the screen, allowing for more stylus options. The use of an optical pen as has been discussed relative to FIG. 4 allows a person to trace over almost any object and create a sewing pattern. Thus the optical pen is advantageous as it can more easily trace a pattern found on the quilt material itself, a photo, etc. and because it does not have a limited area in which a person may trace a pattern as a touch screen or writing tablet would have.

One of the particular advantages of the present invention is that it allows a person to trace a pattern which is to be sewn and thereby directly operates the quilting machine. This is used whether the person is quilting in real time or storing a pattern for later quilting. The person takes the stylus 124 (or another appropriate tool depending on the user interface 130 which is desired) and traces the pattern which is to be quilted. The buttons 136 on the user interface 130 or button(s) 168 on the stylus 124 are pressed while the person is tracing at appropriate points to define start and stop points, corners, changes in stitch length, etc. As the user traces the pattern, a string of coordinates is produced (or X-Y movements) which is recorded into a file. The various other sewing commands such as start/stop or corners are placed into the file at the appropriate time as the user presses buttons to signal these commands at desired points in the traced pattern. Thus, a data file is directly created as the user traces the pattern which contains the necessary commands such as start or stop sewing and the movement coordinates/x-y movements. The data file which is created may be directly played back to sew the pattern into a quilt since the file is a string of movements having the relevant commands therein. The computer 112 thus directly forms a quilting file as the user traces a desired pattern.

As the user is tracing the desired sewing pattern, or if the user loads a previously created pattern file, the sewing pattern may be displayed on the screen 132. This would allow the user the ability to see the file and verify that there are no errors in the sewing pattern. The computer 112 may allow the user to edit the file to correct errors. Such editing may include eliminating a recently traced section of the pattern in order to retrace that pattern section.

In tracing and creating the sewing pattern, the user may create embroidered sections by shading a section of the quilting pattern with stylus strokes. The quilting machine would simply follow the strokes to embroider the designated area. Alternatively, the computer 112 may have a predefined embroidering routine (a set spacing of rows of stitches, etc.) and allow the user to simply indicate an enclosed area which is to be embroidered.

As has been discussed, the computer 112 uses a unique methodology for regulating the stitch length as a quilting pattern is sewn into a quilt. The computer 112 uses a circle based calculation method for determining when a stitch should be made in the quilt. In selecting the operational parameters of the quilting machine or in selecting the qualities of a quilting pattern, the user will select a stitch length. Stitch lengths are often selected as a number of stitches per inch, such as 8 or 12 stitches per inch. This may be done by adjusting a variable resistor or potentiometer or the like to select a desired stitch length or by digitally selecting a stitch per inch, either on the sewing machine 104 or as part of the computer 112 or user interface 130. In these cases, the desired stitch per inch may be provided to the computer 112 as either a digital signal or an analog voltage or resistance.

The computer 112 receives the stitch per inch setting and converts the stitch per inch to an absolute stitch length, typically in inches. The stitch length is squared and stored in the computer. As the X-Y carriage is moved in order to sew the pattern into a quilt, the computer tracks the X and Y movements of the carriage. The computer squares both the X and Y movements of the carriage and adds the resultant values together. The sum of the squares of the X and Y movements is tracked until it equals the squared stitch length stored in the computer, at which point a stitch is requested. In addition to requesting a stitch, the X and Y coordinates of the stitch are recorded and the X and Y movements from these coordinates are squared and added to determine when the next stitch is necessary. In this way, the computer 112 requests or triggers a stitch every time that the X-Y carriage has moved a distance equal to the stitch length from the last stitch. Starting points, stopping points, corners, or the like are indicated by the person tracing the pattern and identified in the pattern file, and are thus known to the portion of the computer 112 handling the stitch regulation. Thus, the computer 112 either affirmatively triggers a stitch at these locations or pauses at these locations until a stitch has been formed. A needle position sensor may be used to verify that a stitch has been made if necessary. A variety of mechanical, electro mechanical or optical sensors may be used to track the position of the needle.

Depending on the sewing machine, the stitch may be triggered as a discrete event (similar to firing a nail gun to place a nail at each desired location) or may be managed as an average value. Triggering a stitch and discretely placing each individual stitch may improve the accuracy of the stitch length, but often places high demands on the sewing machine. Thus, the stitch placement is often managed as an average value. In such a situation, the computer monitors the time between (or time of) a desired number of stitch requests and determines the frequency of stitch requests. This average frequency of stitch requests is typically monitored as a rolling average whereby the computer 112 determines the frequency of a predetermined number of the most recent stitch requests. Often, a number such as 5 or 10 stitches are monitored to determine the stitch frequency. Upon determining the appropriate stitch frequency, the computer 112 operates the sewing machine 104 so that the sewing machine stitches at the desired frequency. Most commonly, the computer 112 interfaces with the sewing machine 104 through the foot pedal plug or another communications port.

The method of tracing a pattern and directly forming a computer file with movement coordinates and commands is particularly advantageous when used in combination with the stitch regulation method discussed above. The stitch regulation method discussed above does not require any information about the pattern which is being sewed in order to determine when or where to place stitches. As such, the computer file with the sewing pattern does not need to contain any information about where stitches are placed. Known prior art quilting machines are difficult to use with user created patterns because the patterns need to have stitch placement information. This may necessitate the need to use complicated software to create a stitching pattern file from an image file, or may prevent the use of user created patterns.

The present quilting machine 100 does not need such information. Thus, it is particularly easy for a user to quilt using custom created patterns because the user need only trace the pattern into the computer 112 and thereby directly create the pattern file with X and Y movements. When a user created pattern is sewn into a quilt, whether in real time (or quasi real time with a buffer) or using a previously saved file, the stitch placement is automatically determine as described above. This also allows a user to easily scale up or down a stitching pattern as only the X-Y carriage movements are scaled, and the stitch placement is automatically determined. The sewing pattern may be easily scaled up or down even when quilting in real time. The computer 112 simply moves the X-Y carriage as calculated by a scaling factor and the movement entered by a user in entering the pattern and determines the stitch placement from the actual movement of the carriage.

A significant advantage of the quilting machine 100 is the ease with which a computer file for quilting a pattern may be created. When a user traces a desired pattern, the computer 112 is able to automatically create the sewing path to follow by simply recording and using the start and stop points and the path of travel used by the person who is tracing the pattern. Thus, a pattern is directly and automatically created in the computer 112 as the user traces with the stylus 124. As the pattern is quilted, the computer 112 automatically and efficiently determines stitch placement directly from the carriage movements.

In contrast, prior art computer files for sewing patterns which are made by scanning in drawings and converting these to sewing files require the use of extensive computer analysis to attempt to determine the optimal start and stop points and path for sewing. This requires software which most users will not have or will not understand how to use. Additionally, the computer determined path and start/stop points may not be the way the person would have chosen to stitch the same object.

Thus, the present invention allows a person to more faithfully stitch their own patterns in their own style while using a computer-controlled quilting machine 100. Thus, the quilting machine 100 is also advantageous as it allows a person to utilize the ease of use of a computerized quilting machine while retaining the charm and originality of hand drawn patterns.

The quilting machine 100 provides significant benefits to persons who are unable to quilt using other machines or by hand due to physical limitations. Many persons suffer from arthritis, a lack of strength, poor eyesight, or other limitations which prevent from quilting by hand or from using other quilting machines. As discussed, prior art quilting machines may require a person move the sewing machine and carriage by hand in order to produce a custom pattern or to simply position and operate the machine. The machine and carriage may weigh 50 pounds or more, and is often difficult to move.

The present invention allows the person to create custom quilting patterns and to move and control the quilting machine by using a stylus 124. Thus, a person who can not bend over the quilt while working may sit comfortably in a chair or bed and use the stylus 124 to operate the quilting machine. Persons who do not see well may user the stylus at whatever viewing distance is convenient for them. Persons with reduced hand control or coordination may user the stylus 124 to trace dewing patterns in large sizes while the quilting machine 100 automatically reduces these to smaller sizes while sewing them into the quilt 108.

Figure 5:
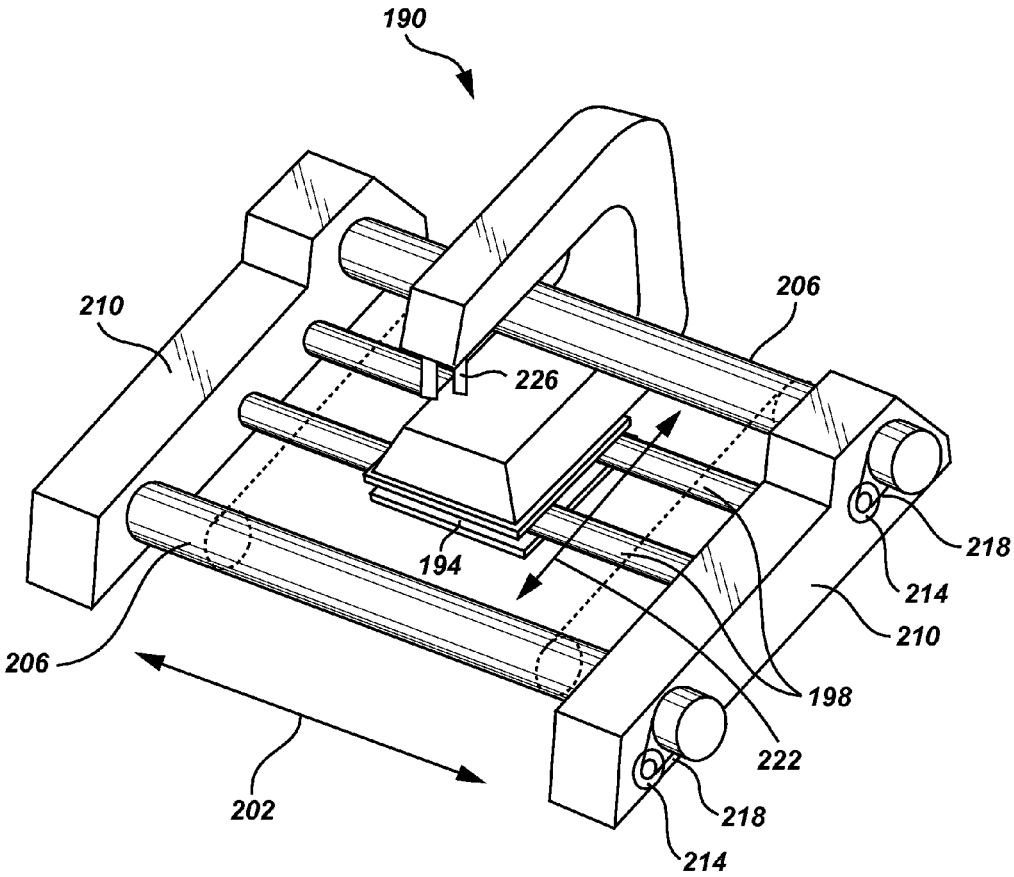
FIG. 5 shows a sewing machine carriage of the present invention.

Turning now to FIG. 5, a novel carriage 190 for use in a computer-controlled quilting machine 100 is shown. As discussed, the quilting machine 100 may use a typical X-Y carriage 42 as is shown in FIG. 2. In this arrangement, the sewing area 116 in which stitching is possible is limited to the X axis movement range of the carriage (left and right as shown by arrow 54 of FIG. 2) and the depth of the throat of the sewing machine (172 of FIG. 3) or the Y axis movement range (forward and backward as shown by arrow 66 of FIG. 2). Thus, the patterns which are sewn into the quilt 108 are limited in size to this range of movement. The X axis movement range typically covers the width of the quilt. The quilt 108 is held stationary, and the sewing machine 104 moves on the X-Y carriage.

The carriage 190 includes an X axis which is similar to that of FIG. 2, and as such includes a base 194 which moves left and right on support rods 198 as indicated by arrow 202. It will be appreciated that known alternatives to the support rods 198, such as rails or tracks, may be used therefore. The base 194 is moved back and forth by a lead screw, gear or chain drive, etc, and is typically controlled with a stepper motor and motor controller as is known in the art.

The Y axis control is not achieved by moving the sewing machine as occurs in the carriage of FIG. 2, but instead occurs by moving the quilt itself. The quilt 108 is rolled onto rollers 206, which are mounted in the end brackets 210. The end brackets 210 allow the rollers 206 to pivot. The rollers 206 are moved by stepper motors 214 which are connected to the rollers 206 via a drive 218. As the motors 214 rotate the rollers 206, a quilt is moved back and forth relative to the sewing machine 204 as indicated by arrow 222. An optical sensor 226 can be used to ensure consistent Y motion of the quilt since the diameter of the quilt which is rolled up on the rollers 206 will change as the quilt is moved back and forth.

The carriage 190 is advantageous as is allows for sewing on the entire surface of the quilt where available X-Y carriages as shown in FIG. 2 are limited to sewing on the exposed area 116 of the quilt. The carriage shown in FIG. 5 is used with the system shown in FIGS. 3 and 4, and thus is understood to include all of the components, features and functionality as discussed above.

For both the carriage designs of FIGS. 3 (an X-Y carriage) and 5, a preferred embodiment of the invention provides a carriage with a mounting base that receives a conventional quilting sewing machine. The computer 112 (which may be integrated with the user interface 130) interfaces with the sewing machine via the foot pedal port or a communications port and may also include a needle sensor or the like. Thus, the quilting machine 100 interfaces with a conventional quilting machine 104, allowing many persons to use their existing sewing machines. This, in combination with the ease of creating custom patterns and the ease of operating the device, allow many persons to use the present device where the strength requirements, added cost, or complexity of other computer quilting machines would prevent their use.

There is thus disclosed an improved method and system for computer-controlled quilting. It will be appreciated that numerous changes may be made to the present invention without departing from the scope of the claims.

What is claimed is:

1. A method of quilting comprising;

a person selecting a computer-controlled quilting machine having:

a sewing machine;

a carriage connected to the sewing machine, the carriage holding a piece of cloth and positioning the cloth so as to enable the sewing machine to sew the cloth;

a computer, the computer being disposed in communication with the sewing machine and the carriage so as to control the operation of the sewing machine and so as to control the operation of the carriage to cause the sewing machine to sew a pattern into cloth;

a user interface, the user interface comprising a remote data entry device separate from the sewing machine which allows a user to trace a pattern without manually moving the sewing machine and thereby electronically transmit the pattern to the computer;

the person selecting a desired stitch length;

the computer storing the square of the stitch length;

the person using the data entry device to trace a pattern;

the computer tracking the movement of the data entry device; and the computer changing the position of the sewing machine relative to the cloth according to the movements of the data entry device to thereby sew the pattern in a piece of cloth in real time as the person traces the pattern; the method further comprising the computer squaring a lateral movement of the cloth relative to the sewing machine from a last stitch position;

the computer squaring a front to back movement of the cloth relative to the sewing machine from a last stitch position;

the computer adding the square of the lateral movement and the square of the front to back movement;

the computer requesting a stitch when the sum of the square of the lateral movement and the square of the front to back movement is equal to the square of the stitch length;

the computer tracking a predetermined number of the most recent stitch requests the computer determining an average frequency of stitch requests for a predetermined number of the most recent stitch requests; and the computer operating the sewing machine to create stitches at said average frequency.

2. The method of claim 1, wherein the data entry device is selected from the group consisting of an optical stylus, a touch screen, and a graphics tablet.

3. The method of claim 1, wherein the computer buffers the movements of the data entry device to facilitate movement of the sewing machine.

4. The method of claim 1, wherein the data entry device comprises a button and wherein the user presses the button while tracing the pattern to indicate starting points and stopping points in the pattern.

5. The method of claim 1, wherein the computer creates and stores an electronic pattern sewing file consisting of two dimensional movement data of the data entry device while tracing the pattern, and wherein the pattern file lacks stitch information.

6. A computer controlled quilting machine comprising:

a sewing machine;

a carriage configured for holding a piece of cloth in a planar configuration, the carriage being connected to the sewing machine, the carriage being movable to change the position of the the sewing machine relative to the cloth so as to sew a two dimensional pattern into the cloth;

a computer connected to the sewing machine and the carriage so as to control the stitching of the sewing machine and to control the movement of the carriage to control the position of the sewing machine relative to the cloth;

a user input device separate from the sewing machine, the user input device being movable by the user to manually trace a pattern without moving the sewing machine and thereby automatically transfer the pattern to the computer electronically; and wherein the computer operates the carriage according to the pattern being traced while the user is tracing the pattern to thereby sew the pattern into the cloth in real time as the user traces the pattern with the user input device: and wherein the computer is programmed to:

receive a stitch length setting;

store the square of the stitch length setting;

compare a sum of a square of a left-right movement and a square of a front-back movement of the sewing machine relative to the cloth and relative to a position of a last stitch; and request a stitch when the sum of the square of the left-right movement and the square of the front-back movement of the sewing machine relative to the cloth and from the last stitch is equal to the square of the stitch length;

track a frequency of stitch requests for a predetermined number of most recent stitch requests, determine an average frequency of said predetermined number of stitch requests, and operate the sewing machine to stitch at the average frequency of stitch requests.

7. The quilting machine of claim 6, wherein the user input device is selected from the group consisting of an optical stylus, a touch screen, and a graphics tablet.

8. The quilting machine of claim 6, wherein the computer creates and stores an electronic pattern sewing file consisting of two dimensional movement data of the user input device while tracing the pattern, and wherein the pattern file lacks stitch information.

9. The quilting machine of claim 6, wherein the computer is programmed to:

receive a stitch length selected by a user;

move the sewing machine relative to the cloth so as to follow a pattern which is traced by a user using the user interface;

automatically determine stitch placement based on the stitch length selected by the user and based on the movement of the carriage; and automatically operate the sewing machine so as to place stitches at desired stitch locations.

10. A method of quilting comprising the steps of:

a person selecting a computer-controlled quilting machine having:

a sewing machine;

a carriage connected to the sewing machine, the carriage holding a piece of cloth and positioning the cloth so as to enable the sewing machine to sew the cloth;

a computer, the computer being disposed in communication with the sewing machine so as to control the operation of the sewing machine;

the person selecting a desired stitch length;

the computer storing the square of the stitch length;

moving the sewing machine relative to the cloth to sew a pattern into the cloth;

the computer squaring a lateral movement of the cloth relative to the sewing machine from a last stitch position;

the computer squaring a front to back movement of the cloth relative to the sewing machine from a last stitch position;

the computer adding the square of the lateral movement and the square of the front to back movement;

the computer requesting a stitch when the sum of the square of the lateral movement and the square of the front to back movement is equal to the square of the stitch length;

the computer tracking a predetermined number of the most recent stitch requests the computer determining an average frequency of stitch requests for a predetermined number of the most recent stitch requests; and the computer operating the sewing machine to create stitches at said average frequency.

11. The method of claim 10, wherein the computer is connected to the carriage so as to control the operation of the carriage and thereby move the sewing machine relative to the cloth.

12. The method of claim 11, further comprising:

the person using a remote data entry device separate from the sewing machine to trace a pattern without manually moving the sewing machine and thereby electronically transmit the pattern to the computer.

13. The method of claim 12, further comprising:

the computer changing the position of the sewing machine relative to the cloth according to the movements of the data entry device as the person traces the pattern with the data entry device to thereby sew the pattern in a piece of cloth in real time as the person traces the pattern.

14. The method of claim 10, further comprising:

the computer creating and storing an electronic pattern sewing file consisting of two dimensional movement data of the data entry device while tracing the pattern, and wherein the pattern file lacks stitch information.

* * * * *